US005512972A

United States Patent [19]

Domen et al.

[11] Patent Number: 5,512,972

[45] Date of Patent: Apr. 30, 1996

[54] PHOTOGRAPHIC PROCESSING APPARATUS

[75] Inventors: Albrecht Domen, Bornem; Bart Verlinden, Tongeren; Bart Verhoest, Kontich; Freddy Van Humbeeck, Keerbergen, all of Belgium

[73] Assignee: AGFA-Gevaert N.V., Mortsel, Belgium

[21] Appl. No.: 235,781

[22] Filed: Apr. 29, 1994

[51] Int. Cl.[6] ..... G03D 3/08

[52] U.S. Cl. ..... 354/319

[58] Field of Search ..... 354/316–323, 354/339, 340; 355/27–29, 100; 226/49, 35, 155, 154, 55–58; 271/10, 114, 116, 256

[56] References Cited

U.S. PATENT DOCUMENTS 3,724,734 4/1973 Sachtleben et al. ..... 226/57

*Primary Examiner*—D. Rutledge
*Attorney, Agent, or Firm*—William J. Daniel

[57] ABSTRACT

Apparatus for processing photographic sheet material including at least two rollers which are rotatively supported on corresponding shafts and biased together by springs acting on one of the shafts is provided with a mechanism operable to separate the rollers. The mechanism consists of a cam carried in normally free-wheeling relation on at least one end of one of the shafts, a cooperating cam follower carried on at least one end of the other shaft and a clutch that can be actuated to engage each such cam on its shaft for temporary rotation therewith to thereby displace the cam into contact with a cam follower and bring about separation of the roller shafts and the rollers supported thereon. The ends of the shaft acted on by the springs is preferably journaled in bearing blocks arranged in a frame for sliding movement towards and away from the other shaft and biased by the springs toward the other shaft. Preferably, the clutch is a one-way clutch that permits free rotation of the cam when the one shaft is rotating in one direction and engages to rotate the cam with the shaft when the shaft is caused to rotate in the other direction. Each cam is held in a given position relative to the frame when free-wheeling on its shaft by a detent abutting against a part of the frame.

6 Claims, 3 Drawing Sheets

PHOTOGRAPHIC PROCESSING APPARATUS

FIELD OF INVENTION

This invention relates to apparatus for the processing of photographic sheet materials and particularly for developing exposed photographic material, and more particularly to apparatus for developing lithographic offset printing plates.

BACKGROUND OF INVENTION

In an apparatus or system for the development of aluminium lithographic printing plates of the type disclosed in EP 410500 it is advantageous to maintain the strength of the processing liquids within specified limits so as to maintain high quality printing plates, and reduce waste products.

During processing the photographic sheet material it is an advantage if the carry-over from one chemical bath to another chemical bath is kept to a minimum. It is therefore known to use pairs of squeeze rollers at the exit of a chemical bath to remove excess chemicals from the sheet material as it exits the bath.

A good removal of processing liquid is also required to reduce the drying time of the sheet material after the last process bath, and hence reduce energy use.

In order to obtain good imaging quality it is necessary for the rollers to exert a load in the order of 0.5–6.0 N/cm roller length to remove excess materials. To this end the rollers are biased together typically by springs which act on the ends of the roller shafts.

During the processing of the photographic material the roller can become coated with gelatin and if the apparatus is switched off with the rollers stationary and biased together then after several hours the rollers become glued together by the gelatin. As a result of this the roller surfaces may become damaged, and the drive gears may also be damaged when the apparatus is restarted.

Furthermore since the rollers have an elastomeric surface, if the apparatus is left with the squeeze rollers biased together, the rollers may take on a set and become temporarily deformed and when the apparatus is restarted this may result in poor quality image reproduction for the first few plates processed on the re-start, after which until the deformation disappears.

There are known mechanisms which can lift the rollers of a pair of squeeze rollers from each other in order to overcome the described problems. One suitable mechanism is disclosed in EP A10 177 873. This mechanism comprises U-like sliding beams extending past a plurality of roller pairs and the legs of which are provided with staggered openings with sloping edges. Depending on the longitudinal position of the beams, bearings of the rollers are either seated on the upper or lower legs of the beams so that the rollers are correspondingly biased towards each other, or are opened. This mechanism requires an in-line mounting of the several roller pairs, it excludes an individual removal of a roller pair for servicing or the like, and an activator must be provided for controlling the position of the beams.

OBJECT OF THE INVENTION

The present invention aims to provide an improved opening or separating mechanism for roller pairs which is easy to install and control.

The invention aims in particular a roller opening mechanism which does not comprise levers or the like interlinking different roller pairs so that there is a bread freedom in the design and location of the different roller pairs in a processor.

The invention provides an opening mechanism which in fact is an elementary unitary assembly which can be used in unlimited numbers in processing apparatus for controlling the opening of a large number of roller pairs.

STATEMENT OF INVENTION

According to the present invention there is provided an apparatus for processing photographic sheet material including at least two rollers rotatable on respective shafts and which are biased together, and moving means operably connected with said one roller shaft for relative moment of said one roller away from the other roller to open the rollers, which is characterised in that said moving means comprises first cam means at each end of said one roller shaft co-operating with second cam means at each end of said other roller shaft to cause the rollers to move apart.

The second cam means can comprise a circular cam mounted to said other roller shaft and the first cam means comprises an eccentric cam which is connected to said one roller shaft through a one way clutch so that in one direction of rotation of said one roller the eccentric cam is free to rotate relative to said one roller, and in the other direction of rotation the-eccentric cam is rotationally fast with said roller, so that rotation of the eccentric cam in said other direction of rotation causes the one roller to move away from the other roller.

BRIEF DESCRIPTION OF DRAWINGS

The invention will be described by way of example and with reference to the accompanying drawings in which.

DETAILED DESCRIPTION OF THE INVENTION

Figure 1:
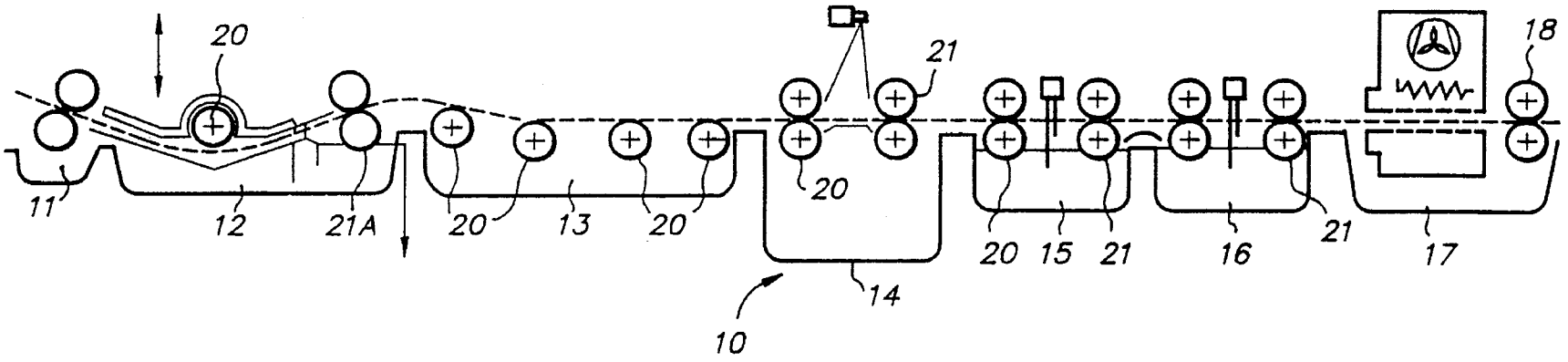
FIG. 1 is a schematic layout of one embodiment of a processing apparatus according to the invention.

With reference to FIG. 1 there is illustrated a longitudinal cross-section through an apparatus 10 for processing exposed photographic sheet material, in particular aluminium lithographic printing plates, of the type described in EP-A-410500.

EP-A-410500 disclosed an imaging element containing an aluminium support provided with in the order given an image receiving layer, and a silver halide emulsion. In the document there is disclosed a diffusion transfer reversal process (hereinafter called DTR-process) for obtaining a lithographic printing plate in which said imaging element is image-wise exposed and subsequently developed using a developing liquid or activating liquid in the presence of a silver halide complexing agent. The imaging element is then guided through a diffusion transfer zone so that the silver halide complexes formed during the development step are allowed to diffuse into the image-receiving layer where they are converted to silver. When the imaging element leaves the diffusion transfer zone a silver image is formed in the image receiving layer. The now useless photosensitive layer and optional other layers above the image receiving layer are then removed by rinsing the imaging element in a washing section. Finally the element now carrying a silver image on its surface is treated with a finishing liquid that contains so called hydrophobizing agent for improving the hydrophobicity of the silver image.

In the above described method for obtaining an aluminium based lithographic printing plate according to the DTR-process generally at least three different liquids are used i.e. a developing or activating liquid, a rinsing liquid and a finishing liquid.

The apparatus 10 is mounted within a generally rectangular housing 22 (FIG. 2) which may include a rectangular metal frame (not shown) for supporting the various parts of the apparatus.

The apparatus comprises a sheet feed means 11, preferably a pair of rollers, a developing section 12, a diffusion transfer section 13, a wash section 14, a rinse section 15, a finishing section 16, a drier 17, and output rollers 18.

All these sections include conveyor rollers 20 and the exit ends of the developing section 12, wash section 14 and the finishing section 16 have sets of squeeze rollers 21 to remove excess liquid from the sheet material as it exits the respective section. Sets of squeeze roller 21 may also be used in the rinse sections.

All the rollers 11, 20, 21, 18 and squeeze rollers are linked by a single drive shaft 34 (see FIG. 2) to operate simultaneously to advance sheet material through the apparatus 10 from the feed means 11 to the output rollers 18.

Figure 2:
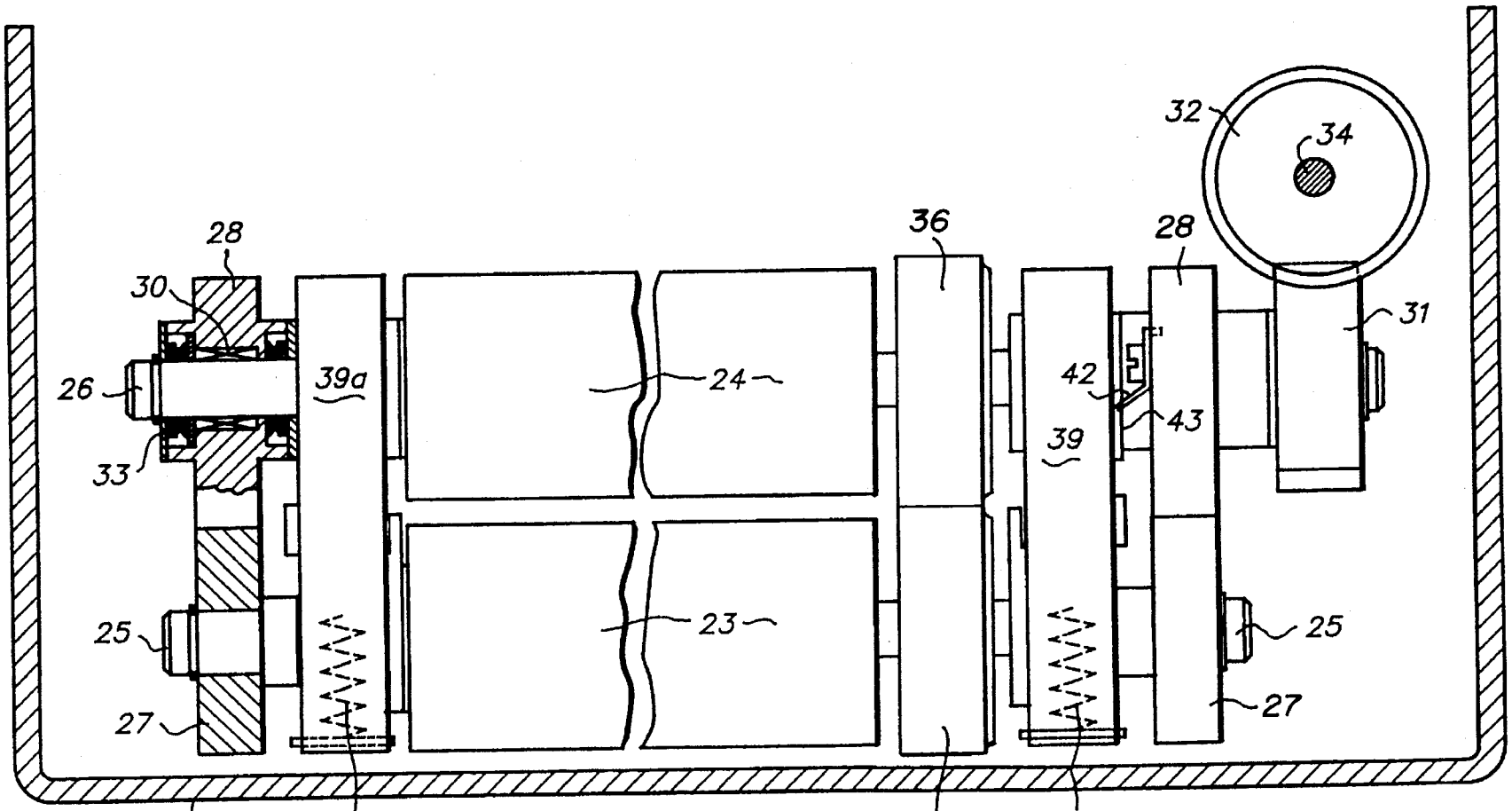
FIG. 2 is an elevation showing one embodiment of the invention having a cam operable moving means showing the rollers in open condition.
Figure 3:
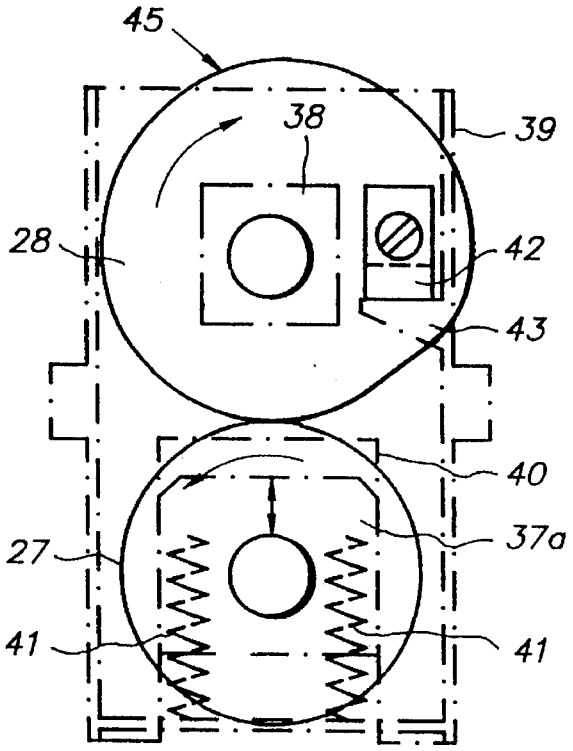
FIG. 3 is a side view of the rollers as shown in FIG. 2 with the rollers in closed condition.
Figure 4:
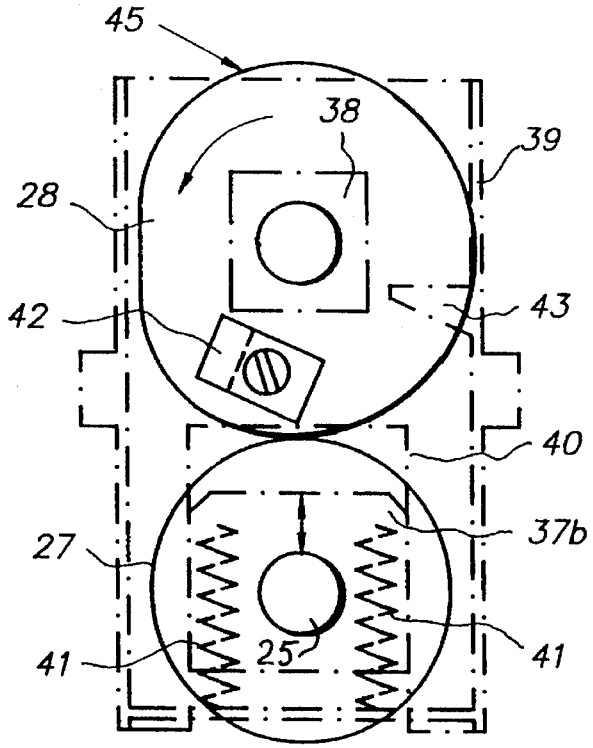
FIG. 4 is a side view of the rollers of FIG. 2 shown in the open condition.

The squeeze rollers 21 at the ends of the sections are best seen in FIGS. 2 to 4. Since each set of squeeze rollers 21 is identical only one set of rollers will be described.

Each set of squeeze rollers 21 comprises a lower squeeze roller 23, and upper squeeze roller 24, which are fixed on respective shafts 25 and 26 for rotation.

The rotation shafts 25, 26 of the lower and upper rollers 23, 24 respectively have cams 27, 28 secured thereto at each end thereof. The cams 27 on the lower roller shaft 25 are circular, acting as cam followed, and may be fixed for rotation with the shaft 25. If the lower cams 27 are made from an engineering polymer such as nylon or acetal resin then the cams 27 may be rotatable on the shaft 25 when no load is applied to the cams and will be held fixed on the shaft by friction when a load is applied to the cams 27. The cams 28 on the upper roller shaft 26 are eccentric, and are secured on the shaft 26 through a one way clutch or bearing mechanism 30 which allows the cams 28 to rotate relative to the shaft 26 in one direction, but locks the cams relative to the shaft 26 in the other direction of rotation (this is shown on one side only of FIG. 2). The one way mechanism 30 is sealed on the shaft 26 by seals 33 to prevent contamination.

The two roller shafts 25, 26 rotate in bearings 37, 38 respectively which are held in a pair of frames 39 located one at each end of the rollers. The upper roller 24 is rotated by a drive gear 31 which is driven by a worm screw 32 on drive shaft 34. The lower roller 23 rotates by engagement its gear 35 with gear 36 of roller 24. The lower roller 23 rotates in its bearings 37 and these slide in guides 40 in the frames 39 so that the lower roller 23 is free to move towards and away from the upper roller 24 as the bearings 37 move between the positions 37*a* and 37*b* as shown in FIGS. 3 and 4. Springs 41 bias the lower roller 23 towards the upper roller 24 by a force of up to 400N. The lower roller 23 is free to move between 1–6 mm away from the upper roller in order to break the miniscus of any process liquid on the rollers.

The eccentric cams 28 on the upper roller 24 are each held in an "at-rest" position during said one direction of rotation by an index clip 42 which rests against an abutment 43 on the respective frame 39. This sets the starting position for the operation of the eccentric cams 28 when upper roller shaft 32 rotates in the other direction of rotation. For example the roller can be made to move apart over the first 180–210 degrees of rotation of the upper cam 28 relative to the lower cam 27, and be held apart at a pre-set distance for 60 degrees of rotation.

Thus in FIG. 3 with the upper roller 24 on shaft 26 rotating clockwise and the two rollers 23, 24 biased together by the springs 41, the lower roller 23 on shaft 25 is driven anticlockwise to pass sheet material through the rollers.

When the upper roller 24 is driven clockwise, the cam 28 rotates on its one way clutch 30 and is held stationary relative to the frame 39.

When the direction of rotation of the upper roller 24 is reversed, the cam 28 now turns with the upper roller and the eccentric cam 28 has its cam surface 45 working against the circular cam 27 to push the lower roller 23 against the bias of the springs 41 away from upper roller 24 (see FIGS. 3 and 4) and open the rollers. This breaks the meniscus of any fluid caught between the rollers.

The frames 39 are removeable from the housing 22 so that the rollers 23–24, frames 39 etc., can be removed from the housing as a complete squeeze roller set 21. The frames 39 can be adapted to receive handles for the removal of the squeeze roller set, the frame 39*a* away from the worm drive being lifted first to disengage the drive gear 31 from the worm drive 32.

In normal operation of the apparatus, the index clips 42 rest against the abutments 43 of the frames 39, and thus the roller pairs are closed.

For the opening of the rollers, the drive is arrested and next reversed, and shaft 34 is made to make a number of revolutions such that, taking into account the reduction factor of worm 32 and gear 31, the cams 38 are rotated over an angle of e.g. at least 180–210 degrees, and at most 240–270 degrees as mentioned hereinbefore, thereby producing the desired opening of the rollers. Rotation of the drive shaft over the desired number of revolutions does not put a problem in present-day apparatus, since drive motors are provided with an encoder disc for accurate speed control. The encoder signal can be used for the control of a desired number of revolutions in reverse direction.

If one roller of a plurality of roller pairs has been removed from the apparatus and is next replaced, it can occur that index clip 42 rests no longer against an abutment 43 or in other words, the angular position of the eccentric cam differs from that of the other cams. If then the apparatus is controlled to open the rollers, said one cam can rotate past its highest point and cause the re-closing of the corresponding roller pair after it has first been opened. Therefore, it is a good procedure to make all the rollers briefly run forward after their mounting in the apparatus, before rotation is reversed to produce their opening.

Finally, it will be understood that if a plurality of roller pairs are used, the simultaneous opening of them will put an extra load on the drive mechanism since all the eccentric cams will displace the corresponding rollers all together according to the same cam cycle. It may therefore be interesting in such case to make the eccentric cams to operate stepwise, in a sense that the opening of one or some roller pairs is started, the opening of the or some next roller pairs is started later, e.g. ten angular degrees of reverse rotation of the cam shaft, that of some other roller pairs still later, etc. This can be done by using all the same eccentric cams but providing different indexing positions for them. Alternatively, different types of eccentric cams can be used, each type offering a different timing while yet producing equal opening rates after a predetermined angle of rotation.

We claim:

1. Apparatus for processing photographic sheet material including at least two rollers rotatable on respective shafts, support means for one of said shafts permitting movement of said shaft toward and away from the other of said shafts to bring said rollers into and out of peripheral contact with one another, means biasing said shafts toward one another, and means for moving said shafts away from one another to separate said two rollers from said peripheral contact, said means for moving said shafts comprising cam means and cooperating cam follower means operable upon displacement of said cam means into engagement with said cam follower means to move said one shaft away from the other said shaft, said cam means being mounted on one of said shafts for normal free-wheeling movement on said shaft without displacement of said cam means and said cam follower means being carried by the other of said shafts, and actuating means for temporarily securing said cam means to said one shaft for rotation therewith and consequential displacement into engagement with said cam follower means to effect separation of said rollers.

2. Apparatus as claimed in claim 1 wherein said cam follower comprises a follower roller mounted on the shaft for said other roller and said cam means comprises an eccentric cam which is connected to the shaft for said one roller through a one way clutch so that in one direction of rotation of the shaft for said one roller the eccentric cam is free-wheeling on the shaft for said one roller, and in the other direction of rotation the eccentric cam is rotationally fast on the shaft for said one roller, and said actuating means comprises means for rotating the shaft for said one roller in said other direction to thereby result in rotation of said eccentric cam is said other direction of rotation and cause the two rollers to separate.

3. Apparatus as claimed in claim 1 wherein the shafts for said two rollers are mounted one above the other with each end thereof supported in bearings held in a corresponding frame section so that said one shaft is in an upper position and is fixed in the frame, said other shaft being slideably mounted in said frame and being biased toward said one shaft by spring means.

4. Apparatus as claimed in claim 2, wherein an eccentric cam is located at each end of said one shaft and said eccentric cams have a cam lift of between 1–6 mm.

5. Apparatus as claimed in claim 4 wherein said eccentric cams are each held against rotation when said one shaft is rotating in said one direction by an index clip which seats against an abutment on a corresponding frame section.

6. Apparatus as claimed in claim 1 wherein said actuating means comprises clutch means.

* * * * *